US007731535B1

(12) United States Patent
Wan et al.

(10) Patent No.: US 7,731,535 B1
(45) Date of Patent: Jun. 8, 2010

(54) RECEPTACLE CONNECTOR ASSEMBLY

(75) Inventors: Wei Wan, HsinTien (TW); Shu Lin Duan, HsinTien (TW); Ching Tien Chen, HsinTien (TW); Pin Yuan Hou, HsinTien (TW); Wen Chih Ko, HsinTien (TW)

(73) Assignee: Advanced-Connectek Inc., Taipei County (TW)

( * ) Notice: Subject to any disclaimer, the term of this patent is extended or adjusted under 35 U.S.C. 154(b) by 0 days.

(21) Appl. No.: 12/394,338

(22) Filed: Feb. 27, 2009

(30) Foreign Application Priority Data

Dec. 24, 2008 (TW) ..... 97223161 U

(51) Int. Cl.
*H01R 13/648* (2006.01)

(52) U.S. Cl. ..... 439/607.4; 439/541.5

(58) Field of Classification Search ..... 439/79, 439/607.11, 607.35–607.4, 540.1, 541.5
See application file for complete search history.

(56) References Cited

U.S. PATENT DOCUMENTS 6,095,861 A * 8/2000 Lin et al. ..... 439/607.25
6,439,926 B1 * 8/2002 Kuan ..... 439/607.4
7,625,245 B1 * 12/2009 Yao ..... 439/660
7,645,165 B2 * 1/2010 Wu et al. ..... 439/607.38

* cited by examiner

*Primary Examiner*—Khiem Nguyen
(74) *Attorney, Agent, or Firm*—Rabin & Berdo, P.C.

(57) ABSTRACT

A receptacle connector assembly comprises an insulative housing, two sets of first contact pins, two sets of second contact pins, a metal contact and a metal shell. The first and the second contact pin respectively comply with specification of USB 3.0 and USB 2.0 and transmit data stability at high transmission rate.

4 Claims, 5 Drawing Sheets

RECEPTACLE CONNECTOR ASSEMBLY

FIELD OF THE INVENTION

The invention relates to a receptacle connector assembly, and more particularly, to a receptacle connector assembly having two sockets that is less susceptible to electromagnetic interference (EMI) and has a higher transmission rate and complies with specification of USB 2.0 and USB 3.0.

BACKGROUND OF THE INVENTION

A Universal Serial Bus (USB) is a hot-swap type transmission interface widely used with computer peripherals, connects hardware to a computer and transmits information without rebooting the computer. A USB 1.1 transmission interface was first released in 1998. In 2007, Intel Corp. released a USB 2.0 transmission interface that allowed the USB interface to be used with more applications including flash drives, printers and mice and having a transmission rate of 480 Mbps, about 40× times faster than the specification of USB 1.1.

As computers have become increasingly powerful and able to process larger amounts of data, computers and computer peripherals have had to be able to transfer more and more data. Transmission efficiency of a USB 2.0 specification is limited by file size that has promoted development of a USB 3.0 specification. The USB 3.0 specification has all the capabilities of the USB 2.0 specification but has more advantages such as lower power consumption and higher transmission rate.

SUMMARY OF THE INVENTION

The objective of the present invention is to provide a receptacle connector assembly complies with specification of USB 2.0 and USB 3.0. The receptacle connector assembly has a stable transmission feature at high data rate.

A receptacle connector assembly comprises plurality of insulative housings, two sets of first contact pins, two sets of second contact pins, a metal contact and a metal shell. The receptacle connector assembly transmits data stably in specification of USB 2.0 and USB 3.0 at a high transmission rate.

DESCRIPTION OF THE PREFERRED EMBODIMENT

Figure 1:
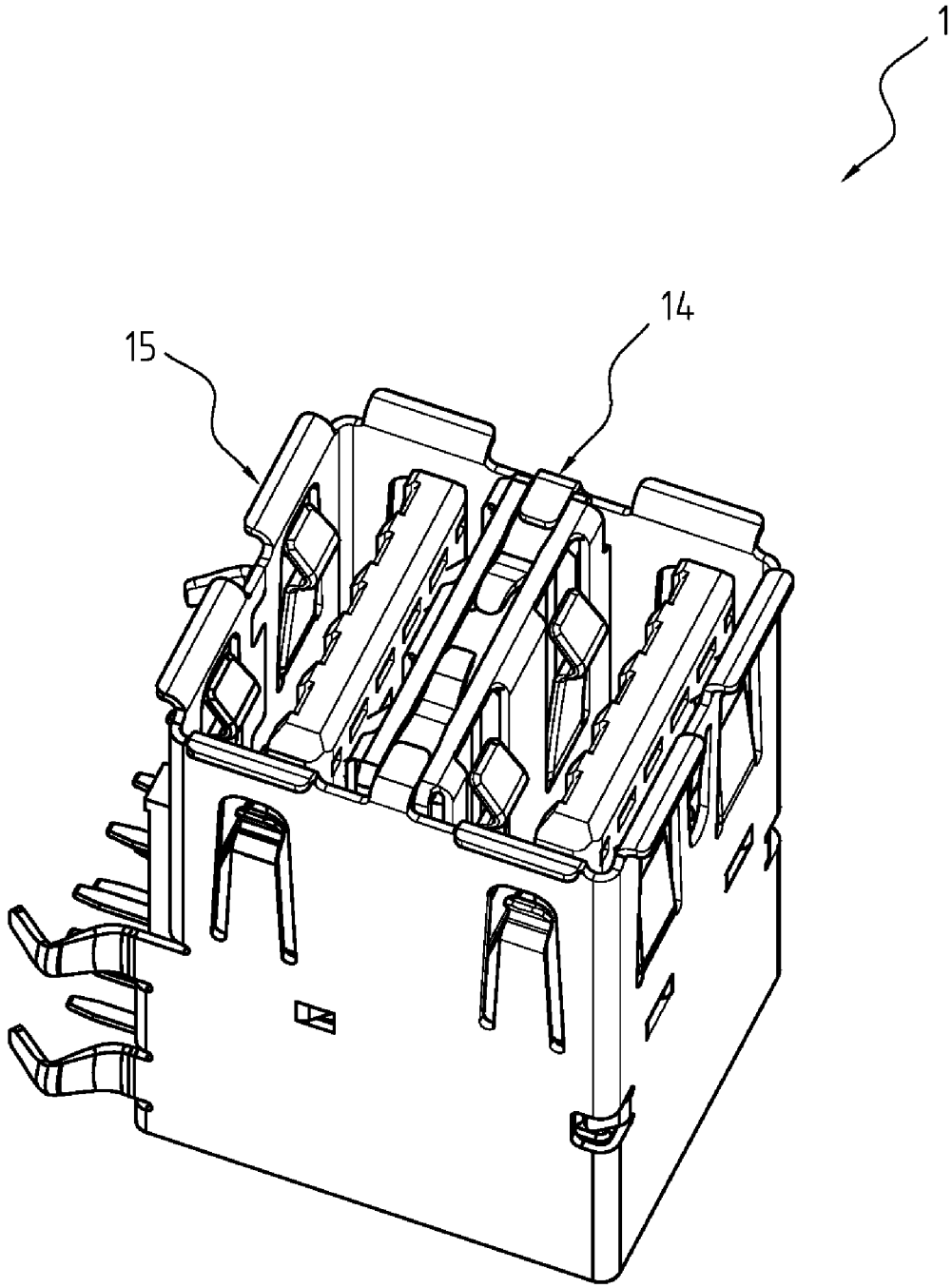
FIG. 1 is a perspective top view of a receptacle connector assembly in accordance with the present invention.
Figure 2:
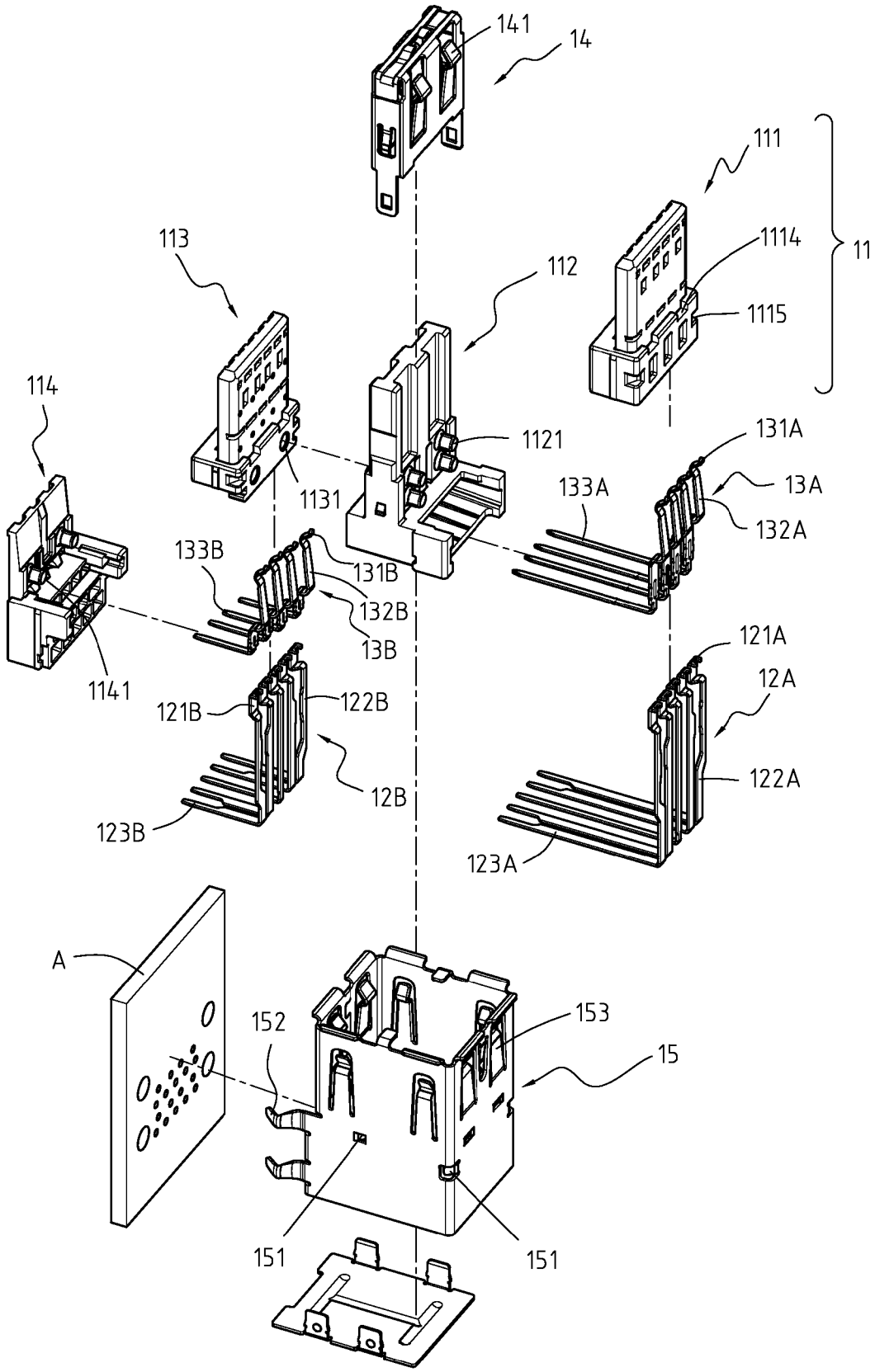
FIG. 2 is an exploded perspective top view of the receptacle connector assembly in FIG. 1.

With reference to FIGS. 1 and 2, a receptacle connector assembly (1) in accordance with the present invention has two sockets corresponding respectively to two plug connectors and comprises plurality of insulative housings (111, 112, 113, 114), an outer set of first contact pins (12A), an outer set of second contact pins (13A), an inner set of first contact pins (12B), an inner set of second contact pins (13B), a metal contact (14) and a metal shell (15).

Figure 3:
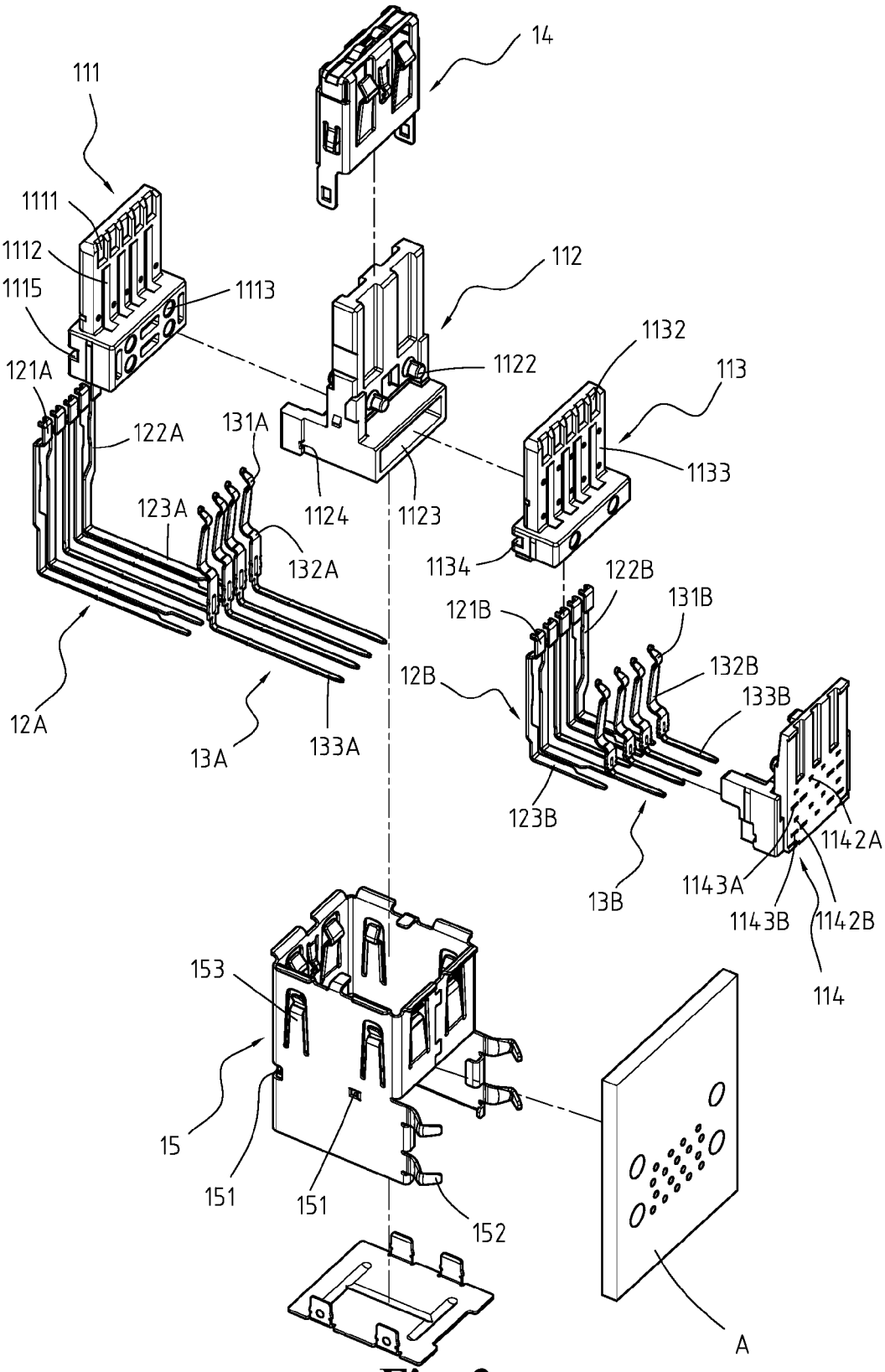
FIG. 3 is an exploded perspective view of the receptacle connector assembly opposite to the orientation in FIG. 2.
Figure 4:
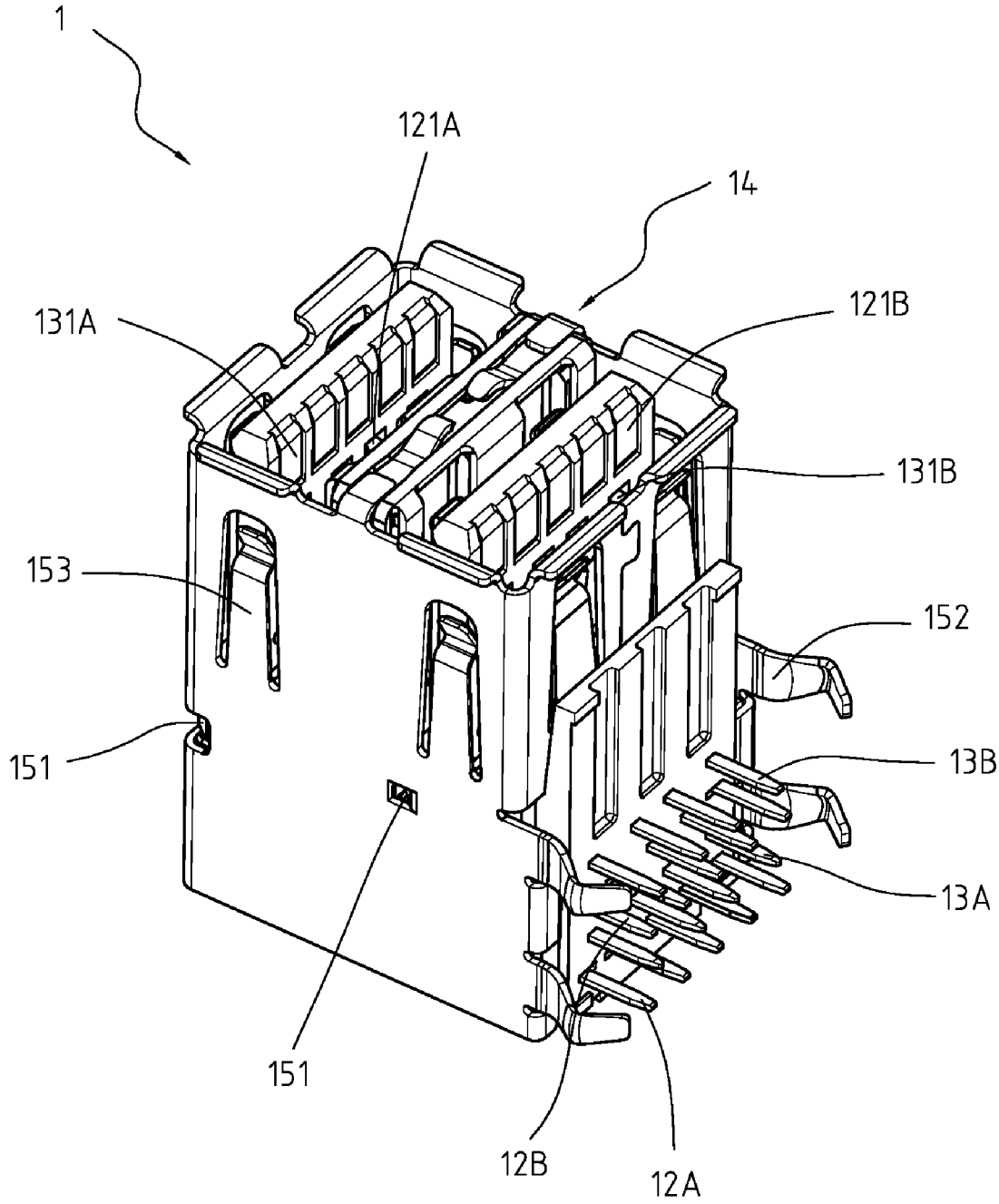
FIG. 4 is an exploded perspective view of an insulative housing in FIG. 1.
Figure 5:
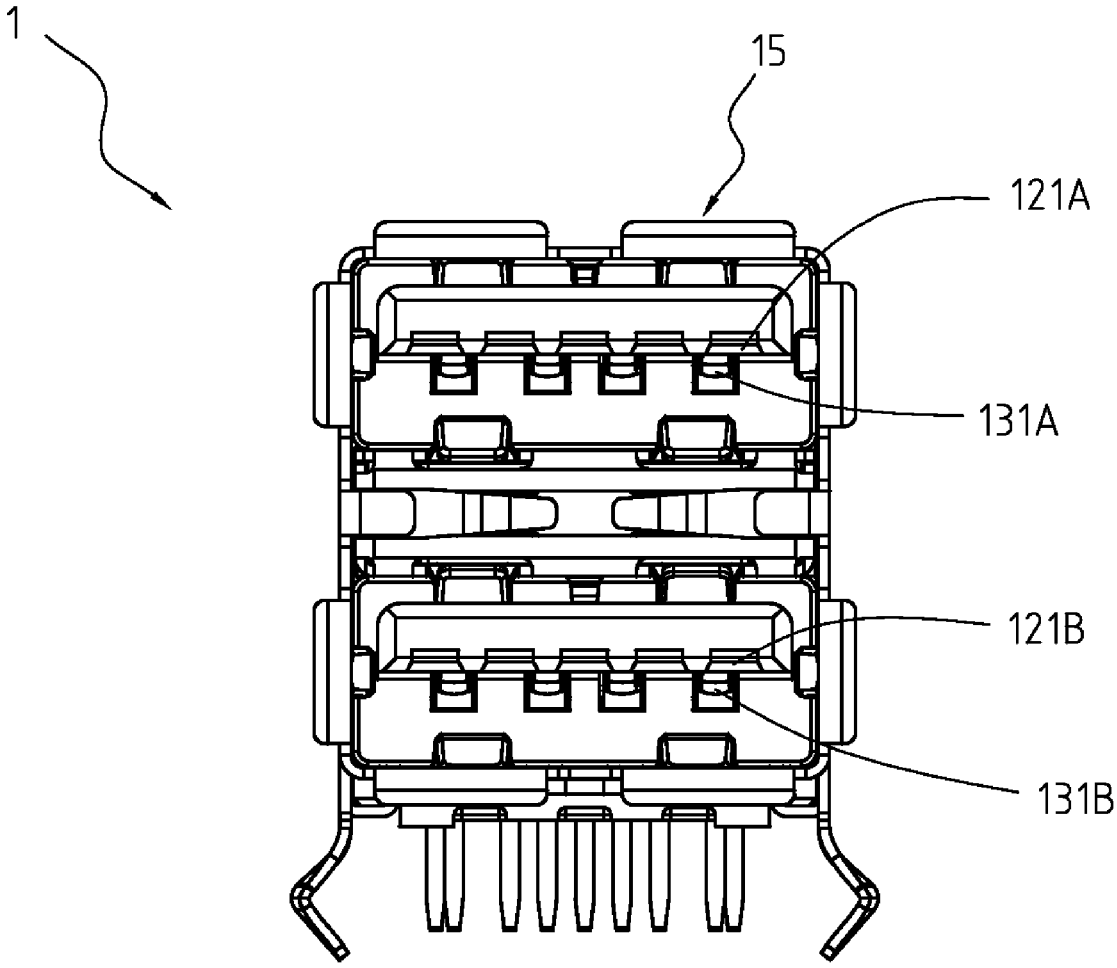
FIG. 5 is a perspective view of an internal component in FIG. 1.

With further reference to FIG. 3, the insulative housings (111, 112, 113, 114) forms two sockets in the receptacle connector assembly (1) and comprises a first insulative housing (111), a second insulative housing (112), a third insulative housing (113) and a forth insulative housing (114).

The first insulative housing (111) has an inner surface and an outer surface. The inner surface has five parallel grooves (1111), four parallel channels (1112) and plurality of positioning holes (1113). The outer surface has plurality of first abutting grooves (1114) and detents (1115).

The second insulative housing (112) comprises a longitudinal body and a transverse portion. The longitudinal body has a first surface, a second surface and a free end. The first surface connects to the inner surface of the first insulative housing (111) and has plurality of first anchor protrusions (1121). The first anchor protrusions (1121) connect respectively to the positioning holes (1113) of the first insulative housing (111). The second surface comprises plurality of second anchor protrusions (1122). The transverse portion has a transverse hole (1123) and two edges. The transverse hole (1123) is formed opposite to the free end. Each edge has a positioning detent (1124).

The third insulative housing (113) connects to the second insulative housing (112) and comprises a longitudinal body and a transverse portion. The longitudinal body has a first surface and a second surface. The first surface of the third insulative housing (113) has plurality of connective holes (1131) to connect respectively to the second anchor protrusions (1122) of the second surface of the second insulative housing (112). The second surface comprises five parallel grooves (1132), four parallel channels (1133) and plurality of recesses (1134).

The forth insulative housing (114) connects to the third insulative housing (113) and comprises a longitudinal body and a transverse portion. The longitudinal body has an inner surface and an outer surface. The inner surface has plurality of positioning holes (1141) to connect respectively to the recesses (1134) of the third insulative housing (113). The transverse portion has two sets of pin positioning holes (1142A, 1142B, 1143A, 1143B).

The outer set of first contact pins (12A) is mounted parallel in the first insulative housing (111), and each first contact pin (12A) comprises a protruded end (121A), an elongated portion (122A) and a first connective end (123A). The protruded ends (121A) are mounted respectively on the grooves (1111) of the first insulative housing (111). The elongated portions (122A) are embedded in the longitudinal bodies of the first insulative housing (111). The connective ends (123A) protrude respectively from the elongated portions (122A) and pass respectively through the pin positioning holes (1142A).

The outer set of second contact pins (13A) are mounted parallel on the first insulative housing (111), and each second contact pin (13A) comprises a resilient contact (131A), a connective portion (132A) and a second connective end (133A). Each resilient contact (131A) has a protruded ball. The connective portions (132A) connect respectively to the resilient contacts (131A) and mount respectively on the channels (1112) of the first insulative housing (111). The second connective end (133A) protrudes from the connective portion (132A) and passes through the pin positioning holes (1143A).

The inner set of first contact pins (12B) mount parallel respectively on the third insulative housing (113), and each first contact pin (12B) comprises an optional protruding end (121B), an optional elongated portion (122B) and an optional first connective end (123B). The protruding ends (121B) mount respectively on the grooves (1132) of the third insulative housing (113). The elongated portions (122B) are embedded in the longitudinal bodies of the third insulative housing (113). The connective ends (123B) protrude from the elongated portions (122B) and pass through the pin positioning holes (1142B).

The inner set of second contact pins (13B) are mounted parallel respectively on the third insulative housing (113), and each second contact pin (13B) comprises a resilient contact (131B), a connective portion (132B) and a second connective end (133B). Each resilient contact (131B) has a protruded ball. The connective portions (132B) connect respectively to the resilient contacts (131B) and mount respectively on the channels (1133) of the third insulative housing (113). The second connective ends (133B) protrude from the connective portion (132B) and pass through the pin positioning holes (1143B).

The metal contact (14) connects to the free end of the second insulative housing (112) and comprises plurality of tongues (141).

The metal shell (15) has four sides and comprises plurality of bosses (151), four pins (152) and plurality of tongues (153). The bosses (151) press against the detents (1115, 1124) to keep the insulative housing (111, 112, 113, 114) mounted correctly in the metal shell (15).

What is claimed is:

1. A receptacle connector assembly comprising plurality of insulative housing forming two sockets of the receptacle connector assembly;

two sets of first contact pins being mounted parallel in the insulative housing, and each first contact pin comprising a protruded end being mounted respectively on the grooves of the first insulative housing;

an elongated portion being embedded in the longitudinal bodies of the first insulative housing;

a first connective end; and a connective portion being protruded respectively from the elongated portions;

two sets of second contact pins being mounted parallel in the insulative housing, and each second contact pin comprising a resilient contact having a protruded ball;

a connective portion being connected to the resilient contact and mounting on the insulative housing; and a second connective end protruding from the connective portion;

a metal contact being connected to the insulative housing, mounted between the sockets and comprising plurality of tongues; and a metal shell having four sides and comprising plurality of bosses pressing against the insulative housing to keep the insulative housing mounted correctly in the metal shell;

four pins; and plurality of tongues.

2. The receptacle connector assembly as claimed in claim 1, wherein the insulative housings comprising a first insulative housing, a second insulative housing, a third insulative housing and a forth insulative housing.

3. The receptacle connector assembly as claimed in claim 1, wherein the first contact pins comply with specification of USB 3.0.

4. The receptacle connector assembly as claimed as claim 1, wherein the second contact pins comply with specification of USB 2.0.

* * * * *